US008133078B2

(12) United States Patent
Lin et al.

(10) Patent No.: US 8,133,078 B2
(45) Date of Patent: Mar. 13, 2012

(54) ELECTRICAL CONNECTOR FEATURED USB/ESATA INTERFACES

(75) Inventors: Chih-Nan Lin, Tu-Cheng (TW); Hung-Chi Yu, Tu-Cheng (TW); Kuo-Chun Hsu, Tu-Cheng (TW); Jui-Kuang Chung, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/750,107

(22) Filed: Mar. 30, 2010

(65) Prior Publication Data

US 2010/0248545 A1 Sep. 30, 2010

(30) Foreign Application Priority Data

Mar. 31, 2009 (CN) ..... 098205046

(51) Int. Cl.
*H01R 24/00* (2011.01)

(52) U.S. Cl. ..... 439/660; 439/607.34; 439/358; 439/218

(58) Field of Classification Search ..... 439/660, 439/607, 356–358, 218
See application file for complete search history.

(56) References Cited

U.S. PATENT DOCUMENTS

| | | | | |
|---|---|---|---|---|
| 7,247,051 | B2 | 7/2007 | Hou | |
| 7,371,116 | B2 * | 5/2008 | Chiang | 439/607.34 |
| 7,517,253 | B1 * | 4/2009 | Chiang | 439/660 |
| 7,628,658 | B1 * | 12/2009 | Chiang | 439/709 |
| 7,833,065 | B2 * | 11/2010 | Lin et al. | 439/639 |

* cited by examiner

*Primary Examiner* — Truc Nguyen
(74) *Attorney, Agent, or Firm* — Wei Te Chung; Andrew C. Cheng; Ming Chieh Chang

(57) ABSTRACT

An electrical connector includes a housing and a set of first terminals for eSATA and a set of second terminals for USB. The housing defines a mating cavity with a front opening and a mating tongue in the mating cavity, the mating tongue defines a first surface and a second surface opposite to the first surface. Each of the first terminals includes a first contacting section disposed on the first mating face, a second contacting section bending from the first contacting section to be in the second mating face and a leg portion. Each of the second contacts includes a contacting section disposed on the second mating face and a leg portion.

15 Claims, 9 Drawing Sheets

ELECTRICAL CONNECTOR FEATURED USB/ESATA INTERFACES

BACKGROUND OF THE INVENTION

1. Field of the Invention

The present invention relates to an electrical connector, and more particularly to an electrical connector compatible to standards of Universal Serial Bus (USB) and External Serial Advanced Technology Attachment (eSATA) protocols.

2. Description of the Related Art

Taiwan Patent No. 7,371,116 issued Jui-Tu Chiang to discloses a connector socket for eSATA and USB plug. This combo electrical connector decrease occupation in electronic components, such as notebook. Thus the combo connector is developed greatly recently.

SUMMARY OF THE INVENTION

The invention is to provide an electrical connector which is mateable with a standard USB 2.0 connector, an eSATA connector in different direction, respectively.

An electrical connector comprises a housing, a set of first terminals for eSATA signal transmission and a set of second terminals for USB signal transmission. The housing defines a mating cavity with a front opening and a mating tongue in the mating cavity, the mating tongue defines a first surface and second surface opposite to the first surface. Each of the first terminals includes a first contacting section disposed on the first mating face, a second contacting section bending from the first contacting section to be in the second mating face and a leg portion. Each of the second contacts includes a contacting section disposed on the second mating face and a leg portion.

Other advantages and novel features of the invention will become more apparent from the following detailed description of the present embodiment when taken in conjunction with the accompanying drawings.

DETAILED DESCRIPTION OF THE INVENTION

Figure 1:
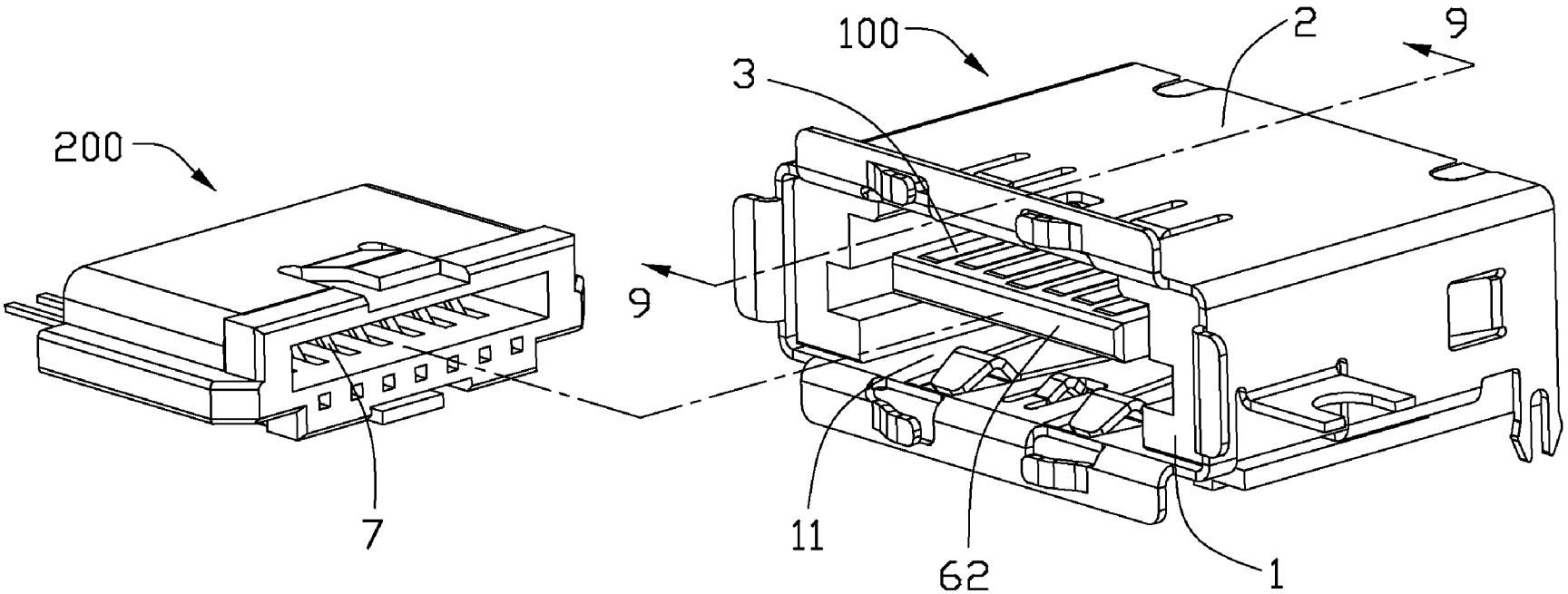
FIG. 1 is a perspective view of an electrical connector and an eSATA plug in accordance with the present invention.

Reference will now be made to the drawing figures to describe the preferred embodiments of the present invention in detail.

Referring to FIG. 1, an electrical connector 100 made in accordance with the present invention is configured to receive a USB 2.0 plug (not shown) and eSATA plug 200 which a plurality of terminals alternatively. The electrical connector 100 includes an insulating housing 1, a shielding shell 2 surrounding the housing 1 to define a mating cavity 11 and a plurality of terminals 3 retained to the housing 1. A mating tongue 62 extends in the mating cavity 11 in a first direction.

Figure 2:
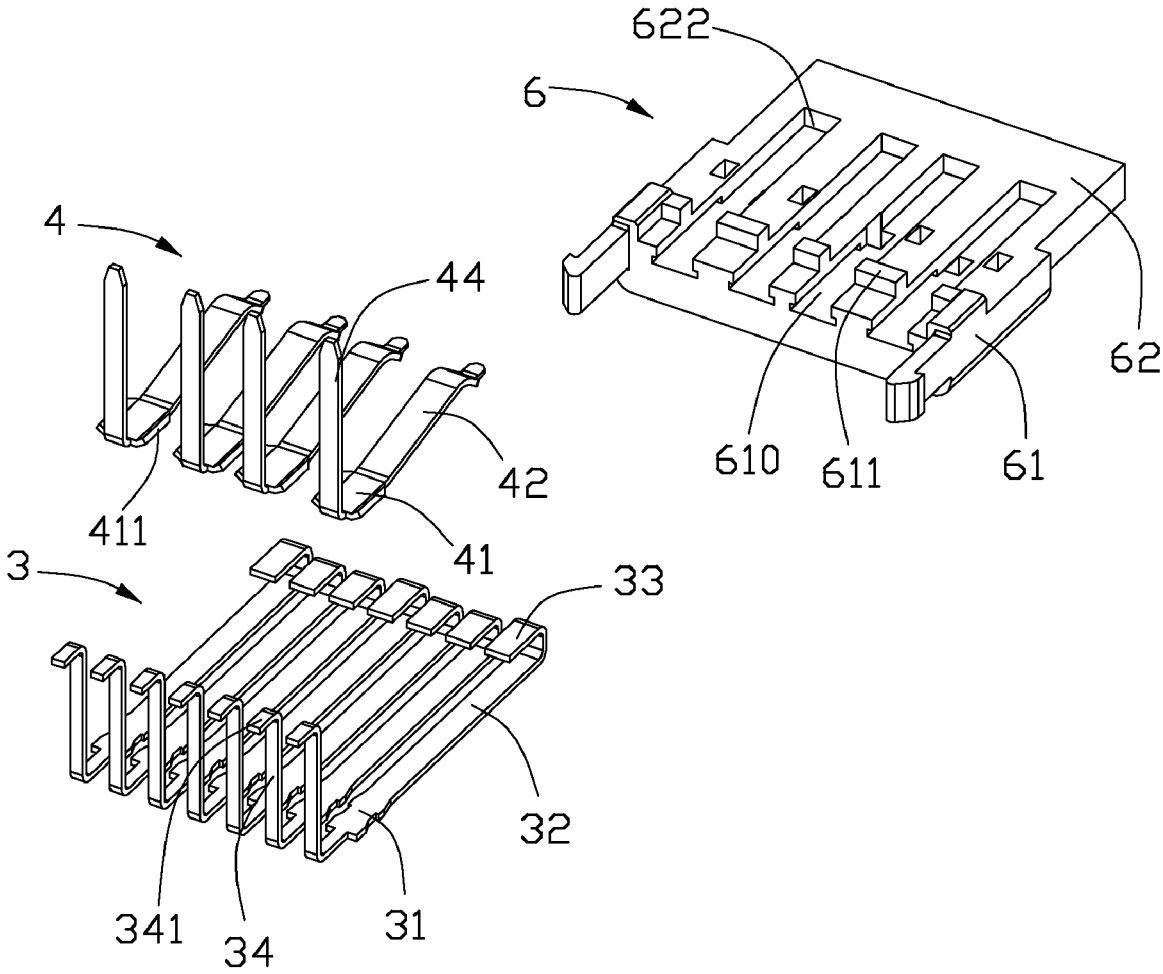
FIG. 2 is an exploded perspective view of insulating board of the electrical connector.
Figure 3:
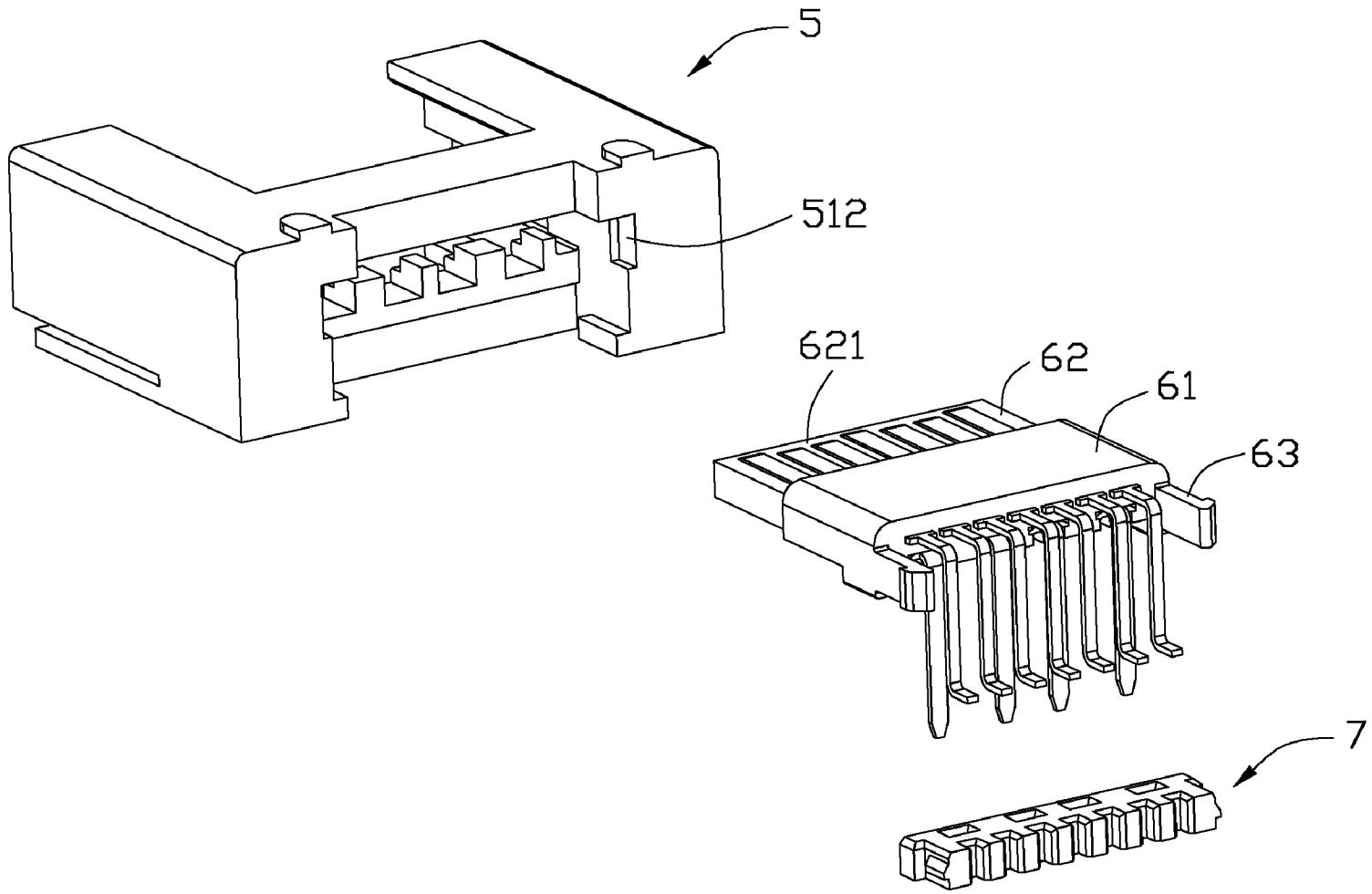
FIG. 3 is an exploded view of insulating base and the insulating board the electrical connector.

Referring to FIG. 2 and FIG. 3, an insulating board 6 includes a base portion 61 and the mating tongue 62 unitarily extending from the base portion. The mating tongue 62 defines a first surface 621 and a second surface 622 opposite to the first surface, both two surfaces has terminal passageways.

Each of terminals 3 of first type for eSATA signal transmission includes a retaining portion 31, a first plate contacting portion 32 extending forward from the retaining portion, a second plate contacting portion 33 bending from a front end of the first contacting portion 32 and a leg portion 34 extending downward from a rear end of the retaining portion 31. The leg portion 34 has a level soldering portion 341 at a free end thereof. The retaining portion 31 and the first contacting portion 32 are embedded in the first surface 621 of the mating tongue 62, while the second contacting portion 33 bends downwards and then inwards to be embedded in the second surface 622 as best shown in FIG. 5.

Each of terminals 4 of second type for USB signal transmission includes a retaining portion 41, an elastic contacting portion 42 extending forward from the retaining portion 41 and a leg portion 44 extending downward from a rear end of the retaining portion 41. The second terminals 4 are inserted into the insulating board 6. The contacting portions 42 are located in the second surface 622 and partially projects beyond the second surface 622. The barbs 411 on lateral sides of the retaining portion bend downwards to interfere with the insulating board 6.

Figure 4:
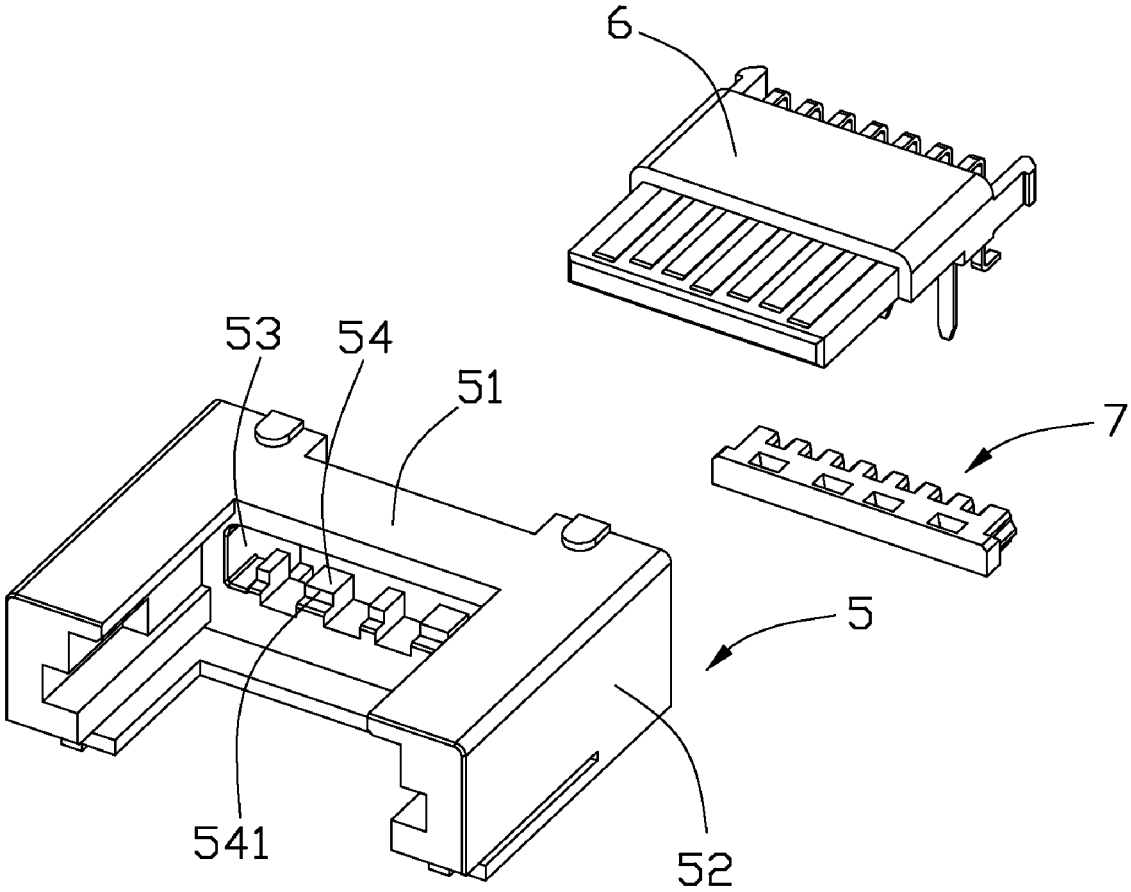
FIG. 4 is an exploded view of insulating base and the insulating board the electrical connector from another direction.

Referring to FIG. 3 and FIG. 4, the insulating board 6 assembled with the first and second terminals 3, 4, is inserted into the insulating base 5. The insulating base includes a rear wall 51 and two sidewall 52 extending forwards from the rear wall 51. The insulating board 6 is inserted into the insulating base 5 from a hole 53 defined on the rear wall 51. A pair of locking arms 63 extending rearwards from a base portion 61 of the insulating board 6 latches with recesses 512 on the rear face of the rear wall 51. The lower face of the hole 53 defines a plurality of embossed portions 54 projecting into the hole 53, a front of which is cut away to form a stop face 541. A plurality of embossed portion 611 as shown in FIG. 2 between the terminal passageways 610 on the second surface 622, are disposed against the stop face 541 to further retain the insulating board 6 in the hole 53. The positioning spacer 7 is to position the leg portions of the terminals.

Figure 5:
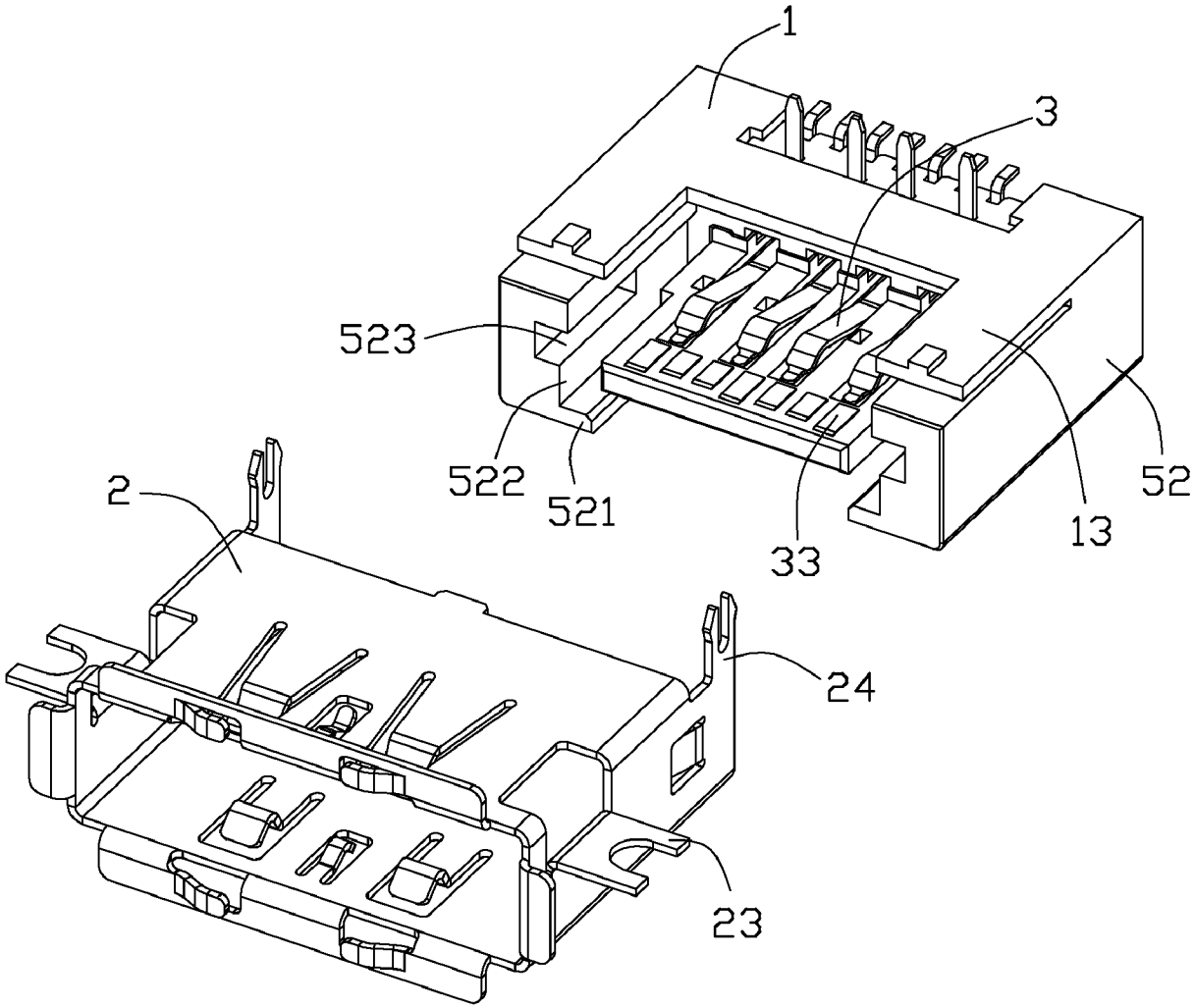
FIG. 5 is an exploded view of the electrical connector.

Combination with FIG. 1 and FIG. 5, the insulating housing 1 is formed with the insulating board 6 and insulating base 5. The shielding shell 2 surrounds the insulating housing 1 to define said mating cavity 11. The mating tongue 62 is located between and spaced away from the inside face 522 of the sidewall 52 and divides the mating cavity 11 into two portions wherein the first surface 621 confronting with the upper cavity section and the second surface 622 confronting with the lower cavity section as best shown in FIG. 1. A supporting board 13 extends forwards from the bottom of the rear wall 51 to support the shell 2. The shell 2 defines horizontal leg portion 23 and vertical leg portions 24 extending from two sidewalls thereof. The inside face 522 of each sidewall 52 defines an inward extending portion 521 adjacent the top edge thereof from the rear wall 51 through the front face of the insulating housing and a recess 522 in the middle portion thereof through the front face while not reach to the rear wall 51. The recess 522 divides the inside face 522 into three parts, an upper segment 5221, a middle segment 5222 and a lower segment 5223. The upper segment 5221 and lower segment 5222 are aligned with each other along the upper to lower direction. Portions of the shielding shell, i.e. the upper wall and lower wall functions as an upper wall and a lower wall of the mating cavity 11.

Figure 6:
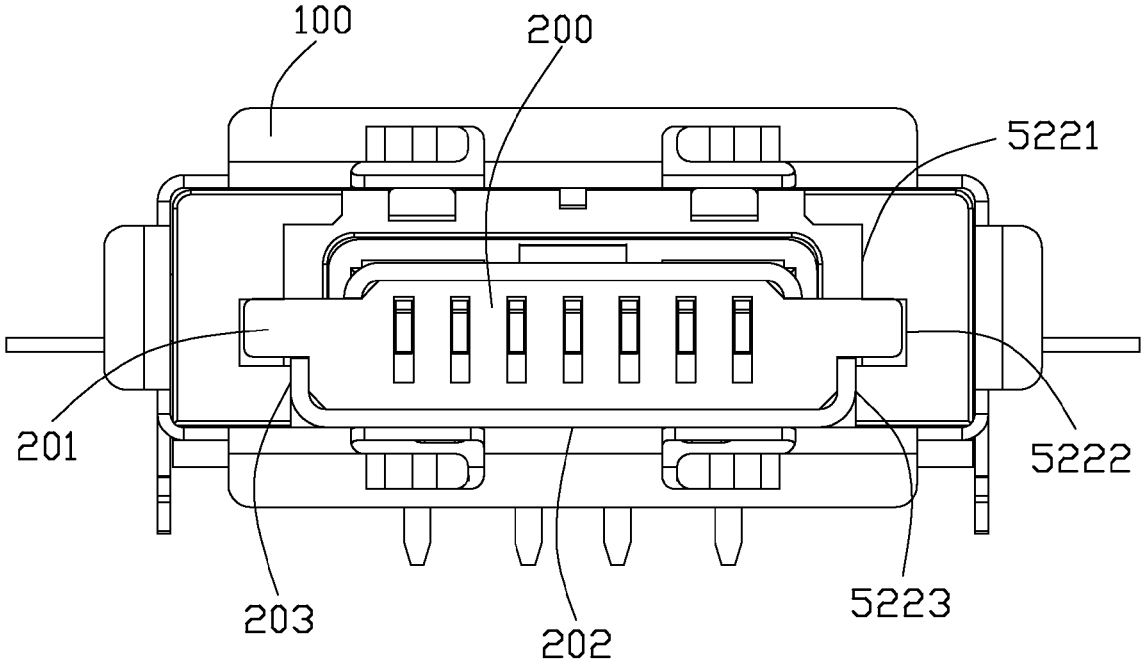
FIG. 6 is a front view of the electrical connector mating with the eSATA plug in an upside downward state.
Figure 7:
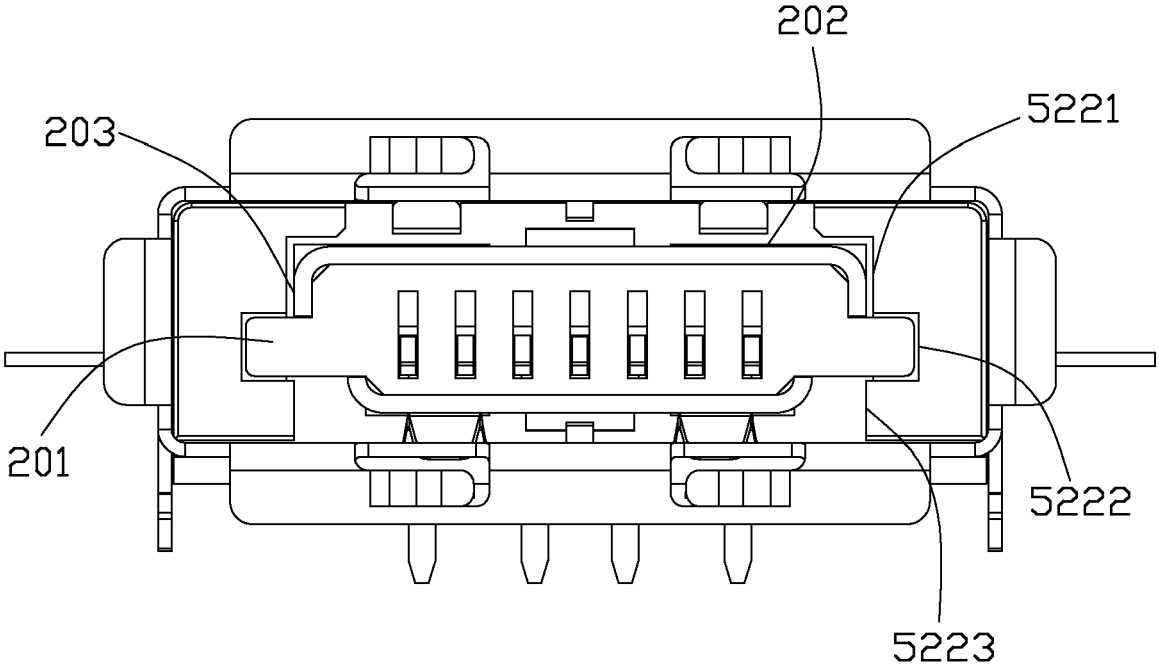
FIG. 7 is a front view of the electrical connector mating with the eSATA plug in an upside upwards state.

Referring to FIGS. 6 and 7 with FIG. 1, the USB plug (not shown) can inserted into the mating cavity 11 and mate with the second terminals 4 to complete electrical connection. FIG. 6 shows the insertion of the eSATA plug 200 in an upside downward states in the mating cavity 11 and the plug 200 mates with the second contacting portions 33 of the first terminals 3. FIG. 7 shows the insertion of the eSATA plug 200 in an upside upwards states in the mating cavity 11 and the plug 200 mates with the first contacting portion 32 of the first terminals 3.

Hereinafter is given the outline for plug 200 in the inside faces of the connector. The plug 200 has portion ribs 201 at opposite sides thereof, which divides the outlines of the plug into two parts, said two parts are different in height and width. In FIG. 6, the position ribs 201 are received in the recesses 523, wherein the lower face 201 of the plug 200 abuts against lower inside wall of the connector provided by the shielding shell, the lateral sides 203 abut against the lower segment 5223 of the inside face 522 so that the plug 200 is limited in an upright direction and traverse direction. In FIG. 7, the lower face 202 of the plug 200 abuts against the inside face of the extending portion 521, the lateral sides 203 abut against the upper segments 5221 of the inside face 522 and the rib portions 201 are received in the recess 523 so that the plug 200 are limited in upright direction and traverse direction. The first contacting portions of the first terminals can be engaged with a eSATA plug inserted in the mating cavity in a first state and the second contacting portions can be engaged with the eSATA plug inserted in the mating cavity in a second state with 180-degree rotation related to the first state.

Figure 8:
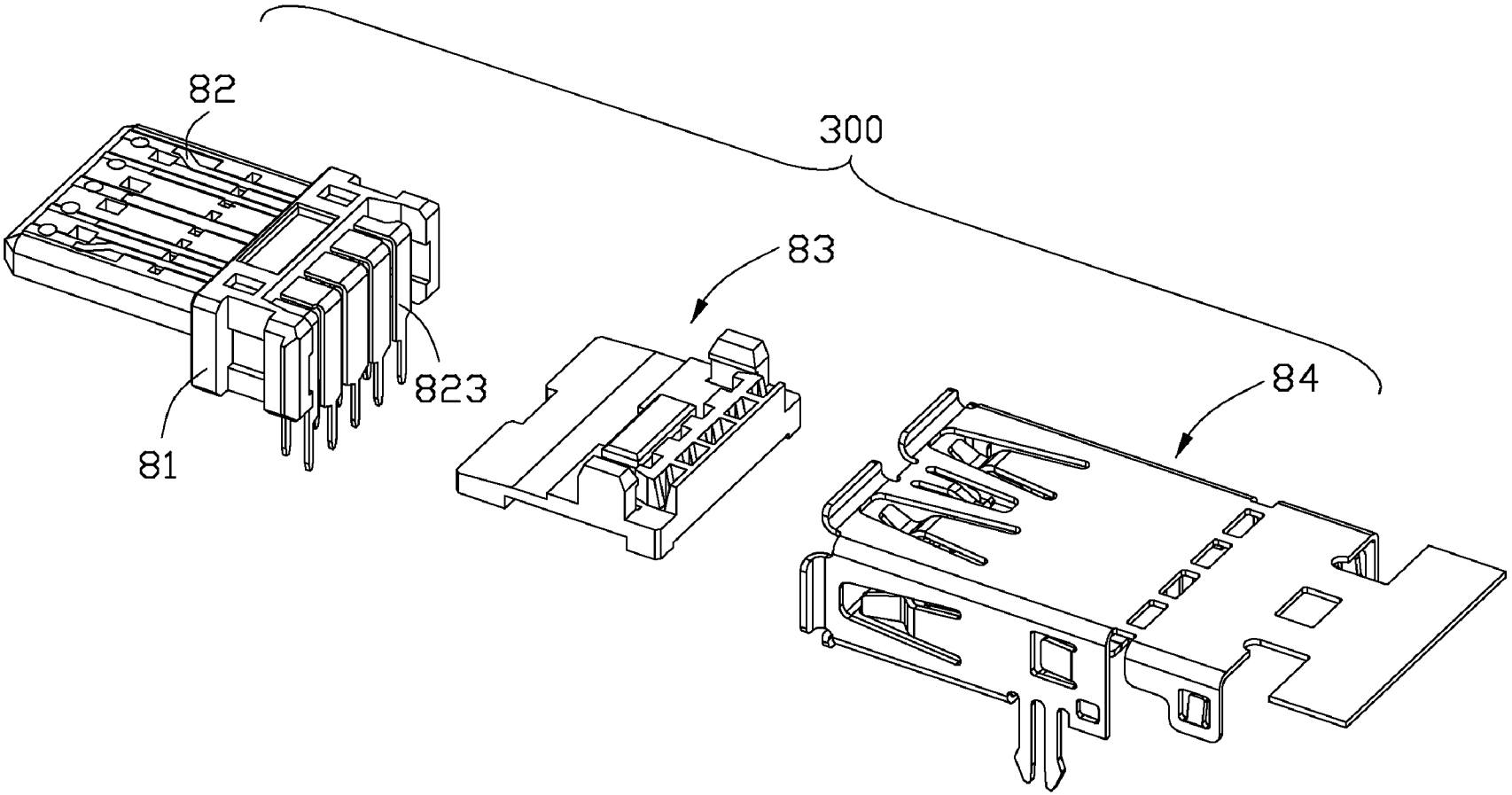
FIG. 8 is an exploded view of an electrical connector of other embodiment.
Figure 9:
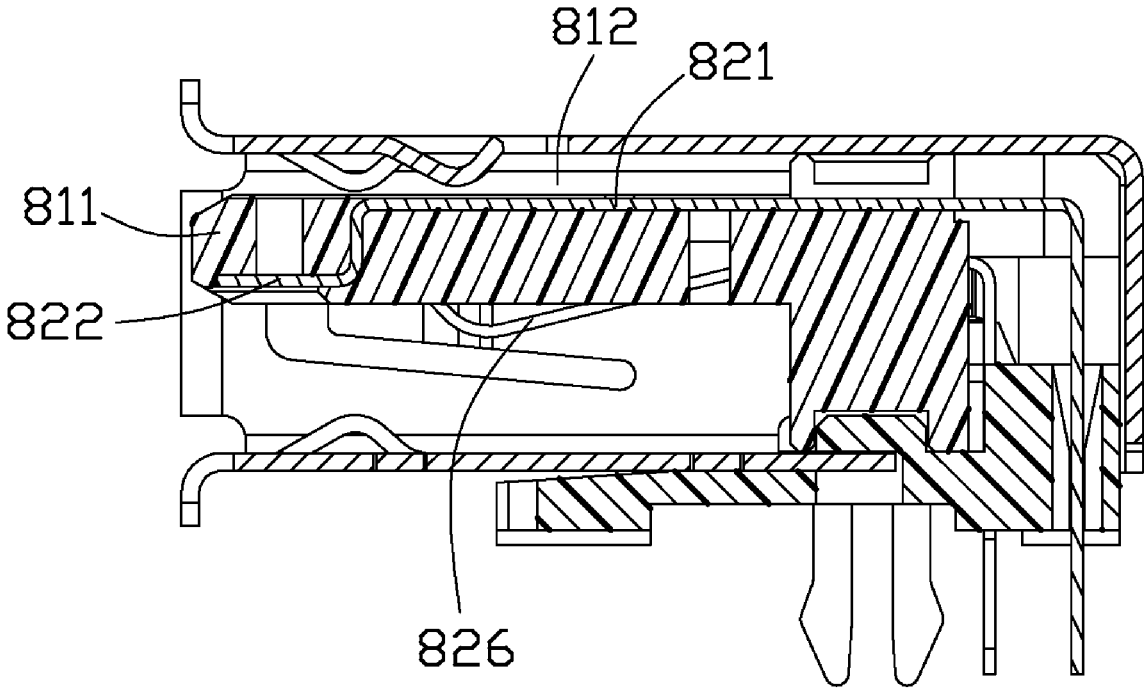
FIG. 9 is a cross-section view of the electrical connector shown in FIG. 8.

FIGS. 8 and 9 show a second embodiment. The insulating base 81 is arranged with terminals 82 and the position spacer 83 is used to position the leg portion 823 of the terminals 82. The shielding shell 84 surrounds the insulating base 81. The terminal 82 includes a first contacting 821 in the first surface of the mating tongue 811 and a second contacting portion 822 bending to the second surface of the mating tongue 811. The first contacting portions 821 open toward to the upper cavity section 812 so that the distance between first contacting portions 821 and the second terminals 826 on the second surface of the mating tongue 811 is enlarged. Since the first contacting portions 821 open toward to the first surface of the mating tongue 811, it is easy to position the terminals in the mold in an insert molding process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing defining a mating cavity with a front opening and a mating tongue in the mating cavity, the mating tongue defining a first surface and seconds surface opposite to the first face;

a set of first terminals for eSATA signal transmission, each of the first terminals defining a first contacting section disposed on the first mating face, a second contacting section bending from the first contacting section to be in the second mating face and a leg portion; and a set of second terminals for USB signal transmission, each of the second contacts defining a contacting section disposed on the second mating face and a leg portion;

wherein the projection of the second contacting portion to the first contacting portion is overlapped.

2. The electrical connector as described in claim 1, wherein the first contacting portions of the first terminals can be engaged with a eSATA plug inserted in the mating cavity in a first state and the second contacting portions can be engaged with the eSATA plug inserted in the mating cavity in a second state with 180-degree rotation related to the first state.

3. The electrical connector as described in claim 2, wherein the housing includes two sidewalls and the mating tongue are disposed between the sidewalls and spaced away from the sidewalls.

4. The electrical connector as described in claim 3, wherein each of the sidewall defines a recess in an inside face thereof to divide the inside face into an upper segment, a middle segment and a lower segment, the upper segment and the lower segment are aligned with each other in an upper to lower direction.

5. The electrical connector as described in claim 3, wherein the housing comprises an insulating base with a hole and an insulating board with a base portion retained in the hole, the mating tongue extends from the base portion of the insulating board.

6. The electrical connector as described in claim 5, wherein the hole of the insulating base has a plurality of spaced embossed portions and a front of each embossed portion are cut away, and the base portion of the insulating board has corresponding spaced embossed portions abutting against the front ends of the embossed portions of the insulating base.

7. The electrical connector as described in claim 6, wherein the housing comprises a shielding shell surround the insulating base, partial of the shielding shell functions an upper wall and a lower walls of the mating cavity.

8. An electrical connector for use with both first plug and second plug, comprising:

an insulative housing defining a base with a mating tongue extending forwardly therefrom, said mating tongue defining opposite first and second surfaces thereon;

a plurality of first contacts disposed in the housing with first side contacting sections on the first surface and second side contacting sections on the second surface;

a plurality of second contacts disposed in the housing with contacting portions on the second surface behind the second contacting section; wherein the housing defines a mating port enclosing said mating tongue with sufficient dimensions and proper configurations thereof in a vertical direction for allowing not only the second plug to be inserted into the mating port in one orientation for electrically and mechanically connecting to the corresponding contacting portions, but also the first plug to be inserted into the mating port with two opposite orientations for respectively electrically and mechanically connecting to the corresponding first side contacting sections and second side contacting sections.

9. The electrical connector as claimed in claim 8, wherein the first plug defines a pair of side ribs on two lateral sides, and another mating port defined in the first plug is offset from the side ribs in a vertical direction.

10. The electrical connector as claimed in claim 8, wherein the second side contacting section unitarily extends from the corresponding first side contacting section, and cooperates with a corresponding mounting leg to have the corresponding first side contacting section located therebetween.

11. An electrical connector, comprising:

an insulative housing defining a mating port and a mating tongue received in the mating port;

a plurality of eSATA contacts, all eSATA contacts each comprising a first contacting portion exposing to a first surface of the mating tongue and a second contacting portion exposing to a second surface of the mating tongue opposite to the first surface;

a plurality of USB contacts, all USB contacts each comprising an elastic contacting section exposing to the second surface and behind the second contacting portions of the eSATA contacts;

every second contact portion of the eSATA contact bending from the corresponding first contact portion without any shift along a transverse direction of the eSATA contacts arranged on the first surface of the mating tongue.

12. The electrical connector as claimed in claim 11, wherein a total amount of the first contacting portions on the first surface ready for mating is same with that of the second contacting portions on the second surface.

13. The electrical connector as claimed in claim 9, wherein the housing defines opposite side walls each with a recess for compliantly receiving the corresponding rib of the first plug.

14. The electrical connector as claimed in claim 9, wherein the first plug defines different widths on upper and lower portions divided by said pair of side ribs.

15. The electrical connector as claimed in claim 8, wherein the first side contacting section and the corresponding second side contacting section are essentially aligned with each other in a vertical direction.

* * * * *